US006482134B1

(12) United States Patent
Rasmussen

(10) Patent No.: US 6,482,134 B1
(45) Date of Patent: Nov. 19, 2002

(54) AEROBIC SLED EXERCISE MACHINE

(76) Inventor: Aaron P. Rasmussen, 1776 Essex St., El Cajon, CA (US) 92020

( * ) Notice: Subject to any disclaimer, the term of this patent is extended or adjusted under 35 U.S.C. 154(b) by 0 days.

(21) Appl. No.: 09/614,245

(22) Filed: Jul. 12, 2000

(51) Int. Cl.[7] ..... A63B 21/068

(52) U.S. Cl. ..... 482/96; 482/97; 482/111; 482/112

(58) Field of Search ..... 482/94–100, 111–112, 482/114, 101, 102, 103, 135, 142, 145, 113, 133–8, 143–6

(56) References Cited

U.S. PATENT DOCUMENTS 4,629,185 A * 12/1986 Amann ..... 272/130
4,632,390 A * 12/1986 Richey ..... 272/120
4,700,946 A * 10/1987 Breunig ..... 272/134
4,911,438 A * 3/1990 Van Straaten ..... 272/138
5,169,363 A * 12/1992 Campanaro et al.
5,263,913 A * 11/1993 Boren ..... 482/96
5,334,120 A * 8/1994 Rasmussen ..... 482/97
5,549,529 A * 8/1996 Rasmussen ..... 482/96
5,810,698 A * 9/1998 Hullett et al. ..... 482/96

* cited by examiner

*Primary Examiner*—Michael A. Brown
*Assistant Examiner*—Lori Baker Amerson

(57) ABSTRACT

A total body exercise machine in which an individual, seated in a body support sled, in a front or rear facing position, may use leveraged bodily force to elevate the sled against hydraulic and weighted resistance. A line trolley, suspended from a header by an assembly of pulleys and lines, tracks on a pair of rails, to pivotally support the upper end of the sled frame. At its lower end, the sled is pivotally joined to a frame mounted, radial indexing apparatus. That apparatus operatively positions a set of front and rear foot platforms, linked to the sled, to transmit leg force and assist in its elevation. Attached at the end of the lines is a set of hand rings, with which the user may use arm force, to help elevate the sled. Finally, the machine frame assembly is collapsible for shipping.

7 Claims, 5 Drawing Sheets

AEROBIC SLED EXERCISE MACHINE

BACKGROUND OF THE INVENTION

The present invention represents evolution in the design of exercise machines that employ pulley, line and lever mechanisms to overcome gravity. Typical applications permit a user to employ bodily force to raise the body, suspended on a tracked conveyance, to a point of elevation. The ultimate apparatus would work a majority of the major muscle groups with simplicity and with a minimum of structure. The present invention employs the exercise methodology of previous machines, but is unique in the disclosure of new structure and kinematic function, particularly with regard to a reduction in manufacturing costs. The latest and most closely related patent documents include patents (4,632,390 12/1986 Richey) ( 5,549,529 8/1996 and 6,015, 369 1/2000 Rasmussen).

SUMMARY OF THE INVENTION

The aerobic sled exercise machine is a fitness machine that works the major muscle groups of the body with traction type movements that operate to stretch rather than compress the spinal column. It is comprised of a support frame with inclined sleeves that telescopically receive a pair of transport rails extending to a header employed to suspend the upper assembly of a pulley and line lift assembly. The lower end of the assembly is attached to a lift trolley that tracks on the rails, drawing a body sled from a point of origin to a point of elevation. The lower end of the sled is pivotally joined to the frame by an indexing apparatus that operates to position leg levers at the front and rear of the machine. The sled is drawn to elevation by a user, seated on the sled in a front or rear facing position, employing arm and leg force to power the sled upward against the force of gravity and adjusted hydraulic resistance. The primary objectives of the machine are summarized as follows.

One object of the invention was to provide a two part collapsible frame assembly having frame sleeves that could telescopically adjust the position of the transport rails and header from an operating height to a compact shipping position.

Another object of the invention was to provide a leveraged lift assembly, suspended from the header, and extending to a rail supported lift trolley, with pivotal connection to the upper end of the sled.

Another object of the invention was to radially suspend the lower part of the sled with a frame mounted index arm, a part of an indexing apparatus designed to join and selectively position leg levers at the front and rear of the machine.

Another object of the invention was to supplement body weight resistance with additional weightedness and/or adjusted hydraulic resistance.

A final object of the invention was to significantly reduce manufacturing costs for the present invention as compared to previous art offering similar exercise options.

DESCRIPTION OF THE DRAWINGS

In FIG. 5A, the machine is shown in the initial at rest configuration. In FIG. 5B, the machine has been drawn to a point of elevation, permitting analysis of the biomechanical elements of the front facing exercise cycle.

In FIG. 6A, the machine is shown in a size adjusted, at rest position. In FIG. 6B, the machine has been drawn to a point of elevation, permitting analysis of the biomechanical elements of the rear facing exercise cycle.

PREFERRED EMBODIMENT OF THE INVENTION

Figure 1:
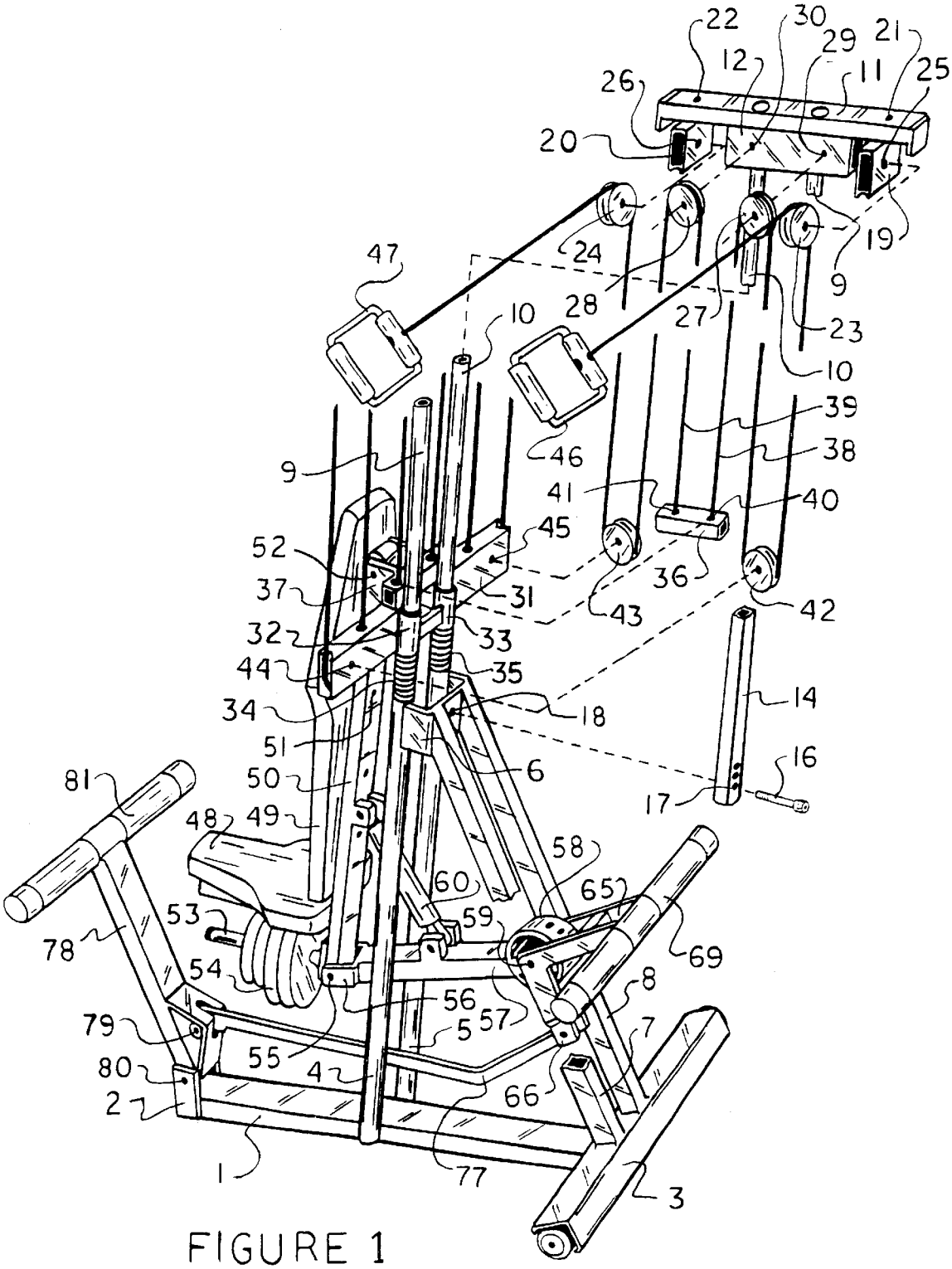
FIG. 1 presents a rear view perspective drawing with a broken frame area exposing the index positioning head. Also illustrated is a revolved skeletal perspective of the pulley and line lift assembly as it would appear absent its housing structure. This figure represents the preferred machine configuration.

The disclosure to follow, accompanied by drawings, describes the kinematic structure of the aerobic sled exercise machine. Common (off the shelf) hardware items that do not contribute to clarity have been omitted in the interest of brevity. FIG. 1 illustrates two partial view representations, the lower drawing descriptive of the frame and sled assembly, and a revolved upper frontal view of the machine header and pulley lift assembly. Shown in FIG. 1, is an elongated, horizontal frame member 1 joined at its front end to a leg lever bracket 2, and attached at its rear end, a T shaped crossbar 3, to complete a tri-pod type footprint. A pair of rearwardly inclined, tubular sleeves 4 and 5, are joined to the frame member 1 at its approximate midpoint, and extend upward to an end point where they are spaced apart by bridge bracket 6. At the rear of frame 1, the crossbar supports a pair of forwardly inclined support struts 7 and 8 that are joined at their upper extension to the bridge bracket 6 to brace the sleeves 4 and 5. Frame members 1 through 8 are all weldment bonded.

Figure 3:
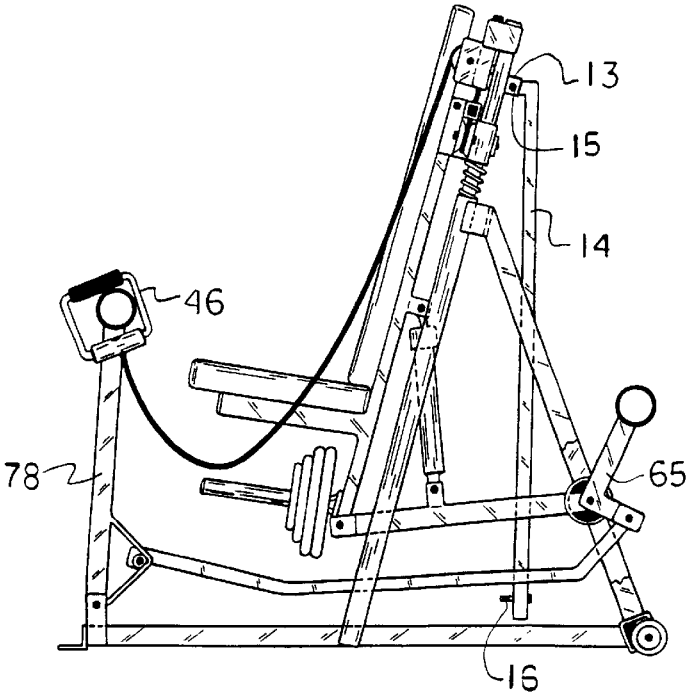
FIG. 3 portrays a right side orthographic view of the machine in the shipping position, with its rails fully telescoped within the frame sleeves and the index head adjusted to the park position.

Fitted to telescope, in sliding fit, within the sleeves 4 and 5, are tubular rails 9 and 10. These rails are position adjustable within the sleeves, their upper extensions weldment joined to header 11, which on its underside, supports a dual pulley housing 12. Fixed at the rear of pulley housing 12 is U bracket 13, visible in FIGS. 2 and 3. Also shown in those figures is riser prop 14, mechanically joined to the U bracket at point 15, and extending downward from that point. Shown in FIG. 1, is the bottom extension of prop 14, through which a fastener 16, penetrates one of a plurality of holes 17 to enter threaded hole 18 of bridge bracket 6. It may be noted that the provision of alternate holes in prop 14 permits telescopic adjustment of the rails and header height. Complete disengagement of fastener 16 results in a significant reduction in shipping height as illustrated in the park position of FIG. 3. The structure thus described in this paragraph and the previous paragraph provide a two part collapsible frame assembly.

FIG. 1 illustrates two additional pulley housings, 19 and 20, that are suspended on swival pinions 21 and 22 near the ends of header 11. Housings 19 and 20 contain pulleys 23 and 24, rotatably mounted on housing axles 25 and 26. Those pulleys, in combination with pulleys 27 and 28, mounted within dual pulley housing 12, on axles 29 and 30, serve to support the upper end of a six strand lift assembly.

The lower end of that assembly rides on a lift trolley, having a pulley housing 31, mounted on bushings 32 and 33 that slide telescopically on tubular rails 9 and 10 respectively. At their bottom ends the bushings are separated from direct contact with frame sleeves 4 and 5 by compression springs 34 and 35 that function to reduce bottoming shock. Housing 31 supports a line anchor 36 at its top side, and a sled hanger 37 on its frontal surface. Two lines, 38 and 39, originate at points 40 and 41 of anchor 36. From those points, they travel upward over pulleys 27 and 28, returning downward therefrom to circumscribe pulleys 42 and 43 mounted on axles 44 and 45 respectively. Emerging from housing 31, the lines again move upwardly to pass over the swivel pulleys 23 and 24 to their destination handrings 46 and 47.

It may be reasoned that the described panel of pulleys and line travel outwardly in parallel strands to add breadth to the handring span while maintaining a comparatively narrow origin width. That arrangement enhances user safety as it requires less protrusion of hardware at the user level. The shown parallel line lift assembly produces an approximate four to 1 leverage ratio.

Figure 2:
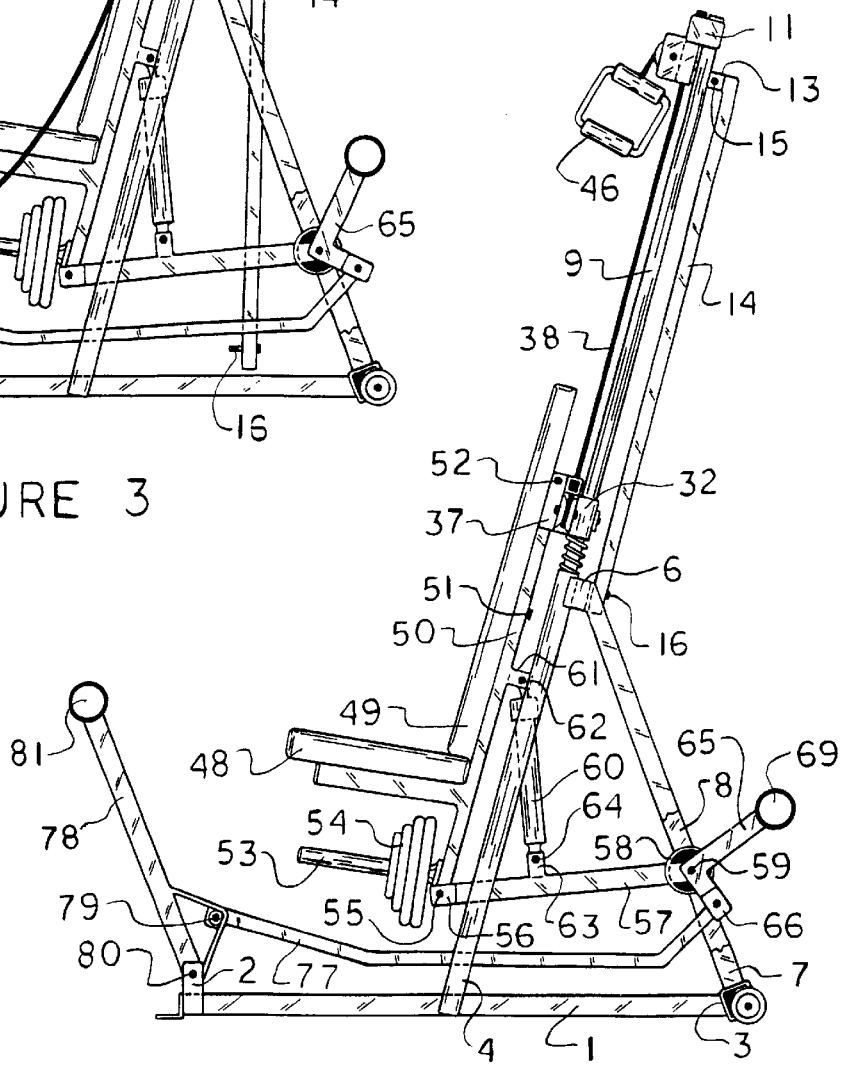
FIG. 2 illustrates a right side orthographic view of the machine with the rails extended and the index head adjusted to position the front and rear leg levers.

As shown in FIGS. 1 and 2, the body support sled has a seat 48 and backrest 49 for use by a front or rear facing user. Both are attached to the sled frame 50 with typical T fastener 51. The sled frame, in turn, is pivotally suspended, at its upper end, on pin 52 of sled hanger 37. At the lower end of frame 50, is weight hanger 53, which extends under seat 48 to carry optional weight plates 54. At its bottom end, the sled frame 50 is pivotally mounted, by means of fastener 55, to yoke 56 of the index arm 57. At its rearward end, arm 57 terminates with an index drum 58, that pivots at its center on axle 59, which is suspended between strut 7 (shown cut away) and strut 8. Thus, elevation of the sled frame produces radial controlled motion at its lower end, eliminating the need for a lower rail tracking mechanism. Resistance to the described radial motion and sled elevation is largely controlled by body and sled gravity, but it can be significantly influenced with the selected setting of an adjustable hydraulic cylinder 60, shown in FIG. 2. In that profile view, the cylinder is pivotally joined at its upper end, to the sled frame bracket 61, with roll pin 62. From that point, it extends downward to join in pivotal union with an index arm bracket 63, with roll pin 64. Thus it may be reasoned that sled elevation extends the cylinder piston.

Figure 4:
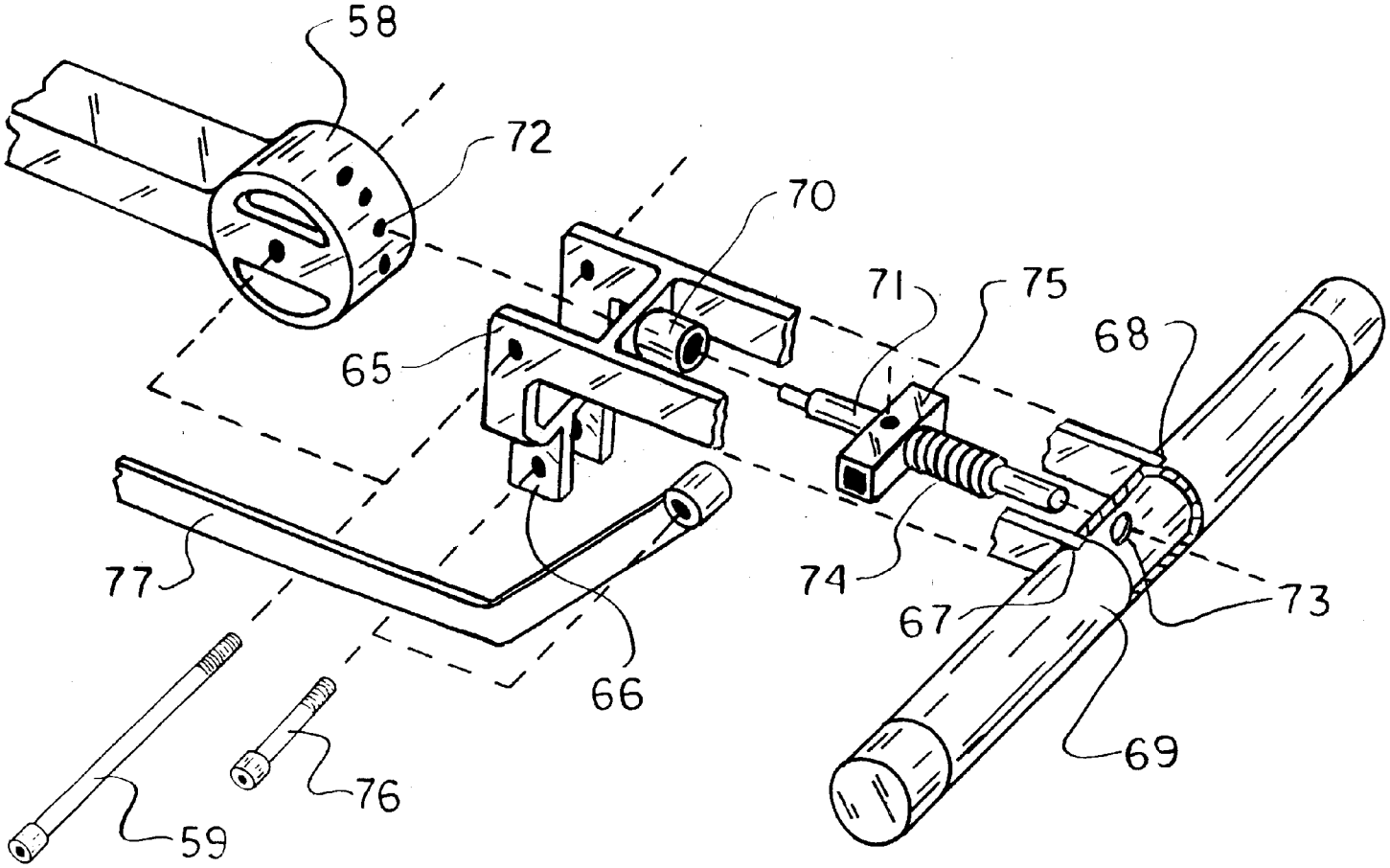
FIG. 4 is an exploded drawing of the index arm assembly indicating its component members and multiple positioning concept.
Figure 5B:
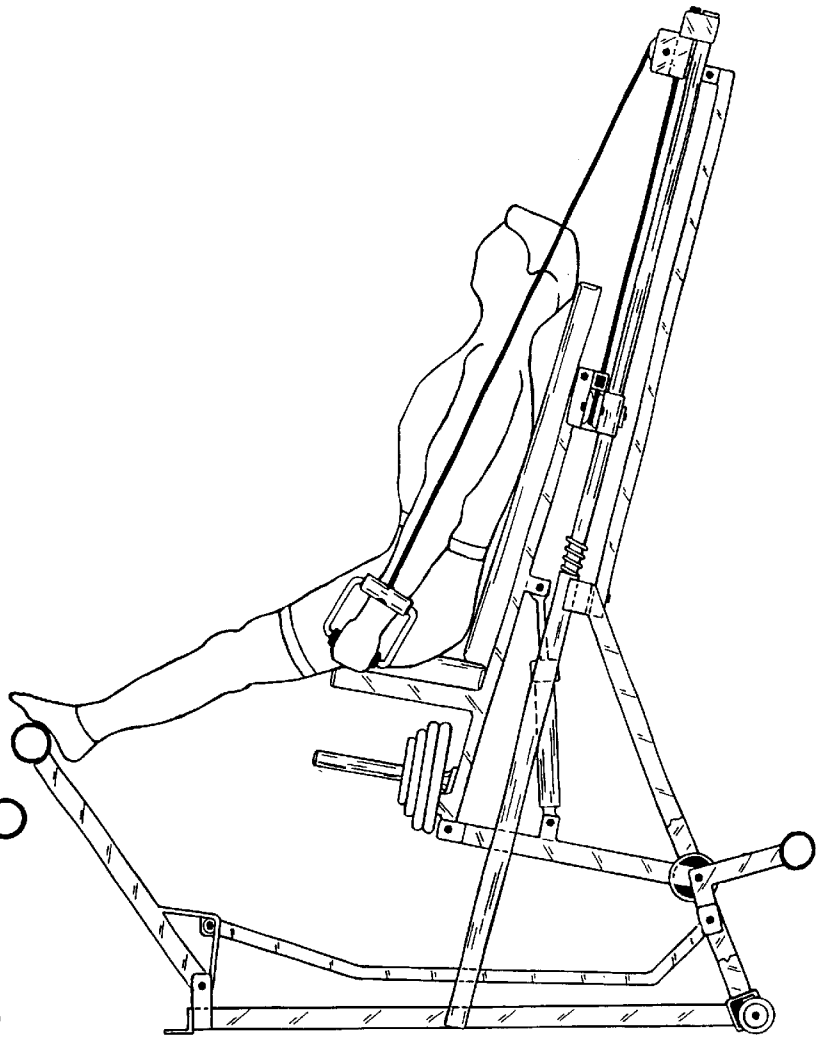
FIGS. 5A and 5B are sequential profile drawings of the machine with a male user, seated in the front facing exercise position.
Figure 5A:
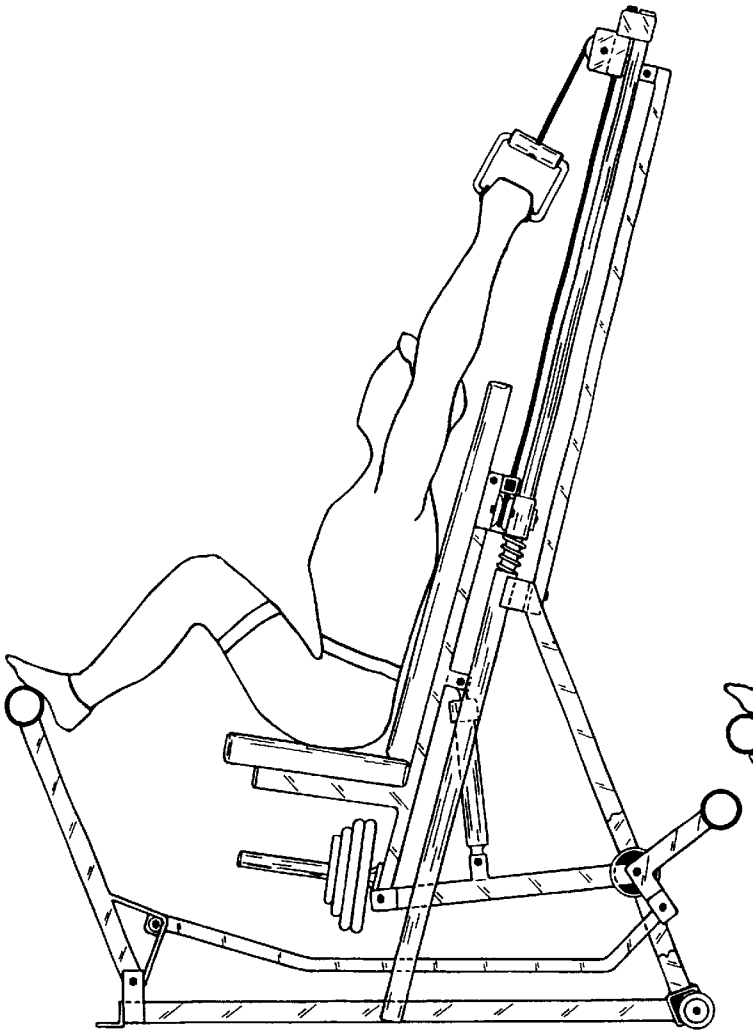
Figure 6B:
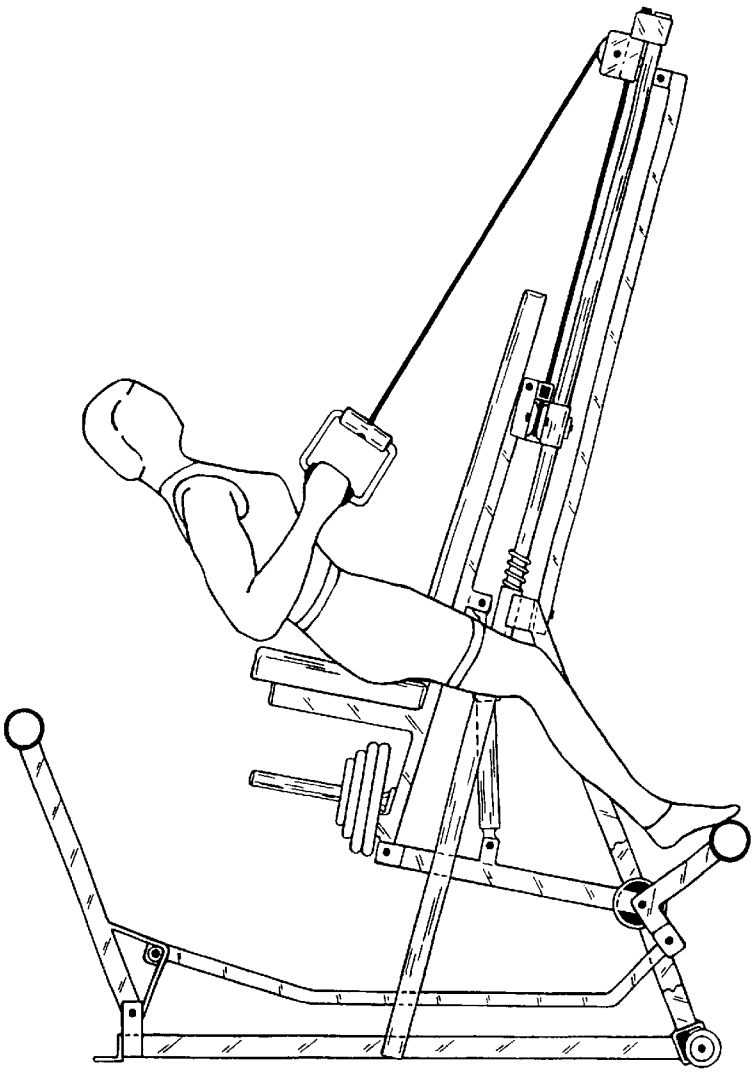
FIGS. 6A and 6B are sequential right side drawings of the machine with a female user, seated in the rear facing exercise position.
Figure 6A:
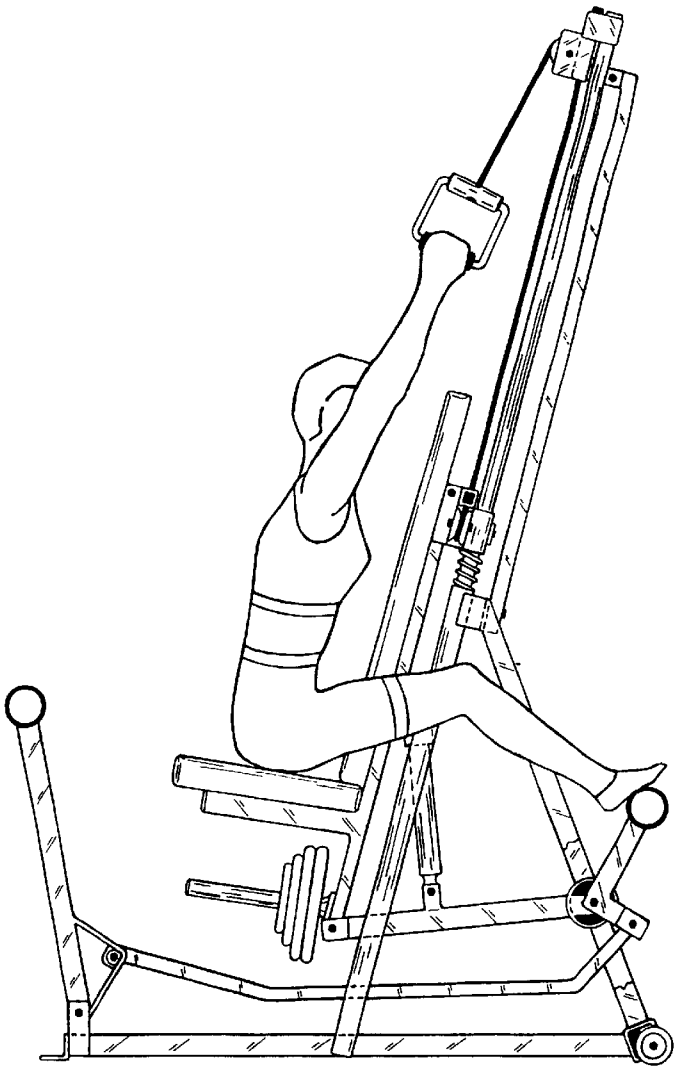

FIG. 4 provides an exploded view of the index assembly designed to adjust the machine to specific body size and limb extensions. In that partial view drawing, is shown the drum housing 65 that encloses index drum 58 and moves in radial fashion on the axle 59, which is the common axis for both drum and housing. Housing 65 has an extended tow bracket 66 fixed at its base, and two rearwardly extended members that act as a leg lever for attachment, at points 67 and 68, to a rear foot platform 69. Housing 65 also has a fixed guide bushing 70, to receive a shoulder turned index pin 71. The pin enters the guide bushing to engage one of a plurality of holes 72 bored in the radial surface of drum 58. At all times, the rear end of pin 71 is supported in hole 73 to stabilize the reciprocal movement of the pin.

A compression spring 74, sleeved over the pin 71, bears against a release bar 75 and the foot platform 69 to lock in a respective position. When the release bar is moved to compress the spring, the pin clears the drum for repositioning in a new hole setting. Also shown in FIG. 4 is fastener 76 that pivotally joins tow bar 77 with the index housing bracket 66, viewed in full in FIG. 2 and other profile views. At its opposite end, the tow bar is pivotally engaged with a front leg lever 78, with fastener 79. Leg lever 78 is pivotally hinged on fastener 80, within frame bracket 2. At its top end, lever 78 supports a front foot platform 81. Thus, any radial repositioning of the index pin relocates the rear and the front foot platforms in simultaneous fashion, reducing the complexity of leg extension adjustments.

FIGS. 5A, 5B, 6A and 6B illustrate male and female machine users in front facing and rear facing exercise positions. The exercise cycle in each illustration depicts the machine and user in a position of origin, and in a position of elevation. The user positions shown demonstrate only two of many bodily orientations used to work different muscle groups, whereas the machine movements are identical for all exercise routines.

What is claimed is:

1. An aerobic sled exercise machine comprising:

a frame having a pair of sleeves fitted to telescopically receive, in sliding fit, a pair of rails joined to an adjustable height header;

an adjustable length bar prop, fixed at its upper end to said header, and disengagably attached at its lower end to the frame;

a pair of transversely housed pulleys, axially joined to the header, and a pair of swivel pulleys, rotatably attached to the header;

a centralized lift trolley that is slidably engaged to track on the rails; said trolley is suspended from the header pulleys by a pair of lines that are anchored to the movable trolley, and rigged, to traverse an assembly of trolley and header pulleys, to leverage a set of hand rings at their end points;

a radial indexing apparatus having an index arm with an attached radial drum, and a bifurcated drum housing, each pivotally mounted, on a common drum axis of the base frame, with means to adjust the angular displacement of the drum housing relative to the drum index arm;

a body sled frame pivotally suspended, at its upper end, to the lift trolley, and pivotally suspended at its lower end to the drum index arm;

a foot platform attached to a first extension of the bifurcated index housing;

a tow bar pivotally attached to a second extension of the bifurcated index housing;

a leg lever, with an attached foot platform that is pivotally joined to the base frame and to the tow bar, to operatively transfer leg force from the lever, through the indexing assembly, to the sled frame;

an adjustable, hydraulic cylinder pivotally connected to the index arm and to the body sled frame, to moderate resistance to sled frame elevation.

2. The aerobic sled exercise machine of claim 1, wherein said header is height regulated with a bar prop that is pivotally attached to said header, and joined, through one of a plurality of holes, to said base frame; removal of said bar prop permits the two part frame assembly to collapse for shipping.

3. The aerobic sled exercise machine of claim 1, wherein said trolley anchored lines are rigged to travel over said header housed pulleys, under said trolley housed pulleys, and over said swivel pulleys to said hand rings.

4. The aerobic sled exercise machine of claim 1, wherein said body sled frame has a padded seat and backrest suitable for occupancy, by a rear-facing or a front-facing machine user.

5. The aerobic sled exercise machine of claim 1, wherein said radial indexing apparatus further comprises a radial drum with a plurality of aligned holes bored about its circumference, and a bifurcated housing that supports a spring loaded, locator pin; said pin is selectively engaged in one of the circumferential holes of said radial drum, to operatively adjust the angular displacement of said housing.

6. The aerobic sled exercise machine of claim 1, wherein a user may direct force on said hand rings and said foot platforms, to elevate said body sled against hydraulic and weighted resistance.

7. An aerobic sled exercise machine comprising:

a machine frame, including a pair of inclined, spaced apart, tubular sleeves and sleeve support struts;

a pair of rails fitted to extend telescopically from within the sleeves, supported at an adjusted height by a bar prop;

a header, with pulley housing means, joined to the top of the rails;

a centralized lift trolley that is slidably engaged to track on the rails; said trolley is suspended from the header pulleys by a pair of lines that are anchored to the movable trolley, and rigged, to traverse an assembly of trolley and header pulleys, to leverage a set of hand rings at their end points;

a radial indexing apparatus having an index arm with an attached radial drum, and a bifurcated drum housing, each pivotally mounted, on a common drum axis of the base frame, with means to adjust the angular displacement of the drum housing relative to the drum index arm;

a body sled frame pivotally suspended, at its upper end, to the lift trolley, and pivotally suspended at its lower end to the drum index arm;

a foot platform attached to a first extension of the bifurcated index housing;

a tow bar pivotally attached to a second extension of the bifurcated index housing;

a leg lever, with an attached foot platform that is pivotally joined to the base frame and to the tow bar, to operatively transfer leg force from the lever, through the indexing assembly, to the sled frame;

an adjustable, hydraulic cylinder pivotally connected to the index arm and to the body sled frame, to moderate resistance to sled frame elevation.

* * * * *